United States Patent [19]

Van den Sype et al.

[11] 4,042,423

[45] Aug. 16, 1977

[54] METHOD FOR PROVIDING STRONG WIRE AND STRIP

[75] Inventors: Jaak Stefaan Van den Sype, Mount Kisco; William Alphonse Kilinskas, Cortlandt, both of N.Y.; Richard Benedict Mazzarella, Indianapolis, Ind.

[73] Assignee: Union Carbide Corporation, New York, N.Y.

[21] Appl. No.: 637,392

[22] Filed: Dec. 3, 1975

[51] Int. Cl.[2] ..... C21D 9/52

[52] U.S. Cl. ..... 148/12 B; 148/12 E; 148/12.3; 148/12.4; 148/125

[58] Field of Search ..... 148/12 B, 12 E, 12.3, 148/12.4, 125, 37, 38

[56] References Cited

U.S. PATENT DOCUMENTS

| | | | |
|---|---|---|---|
| 2,395,608 | 2/1946 | Aborn | 148/12 E |
| 2,974,778 | 3/1961 | Ellis et al. | 205/21 |
| 3,152,934 | 10/1964 | Lula et al. | 148/12.3 |
| 3,197,851 | 8/1965 | Aleck | 29/421 |
| 3,473,973 | 10/1969 | Maekawa et al. | 148/12.3 |
| 3,486,361 | 12/1969 | Vaneman et al. | 72/278 |
| 3,615,921 | 10/1971 | Delgrosso | 148/125 |

*Primary Examiner*—W. Stallard
*Attorney, Agent, or Firm*—Saul R. Bresch

[57] ABSTRACT

A method for improving the strength of wire or strip having a composition which consists essentially of an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C and an Ms temperature of no higher than about minus 100° C comprising the following step:

stretching the wire or strip uniaxially at a strain of at least about 10 percent and at a temperature no higher than about minus 75° C in such a manner that the wire or strip has a martensite phase of at least about 50 percent by volume and an austenite phase of at least about 10 percent by volume.

8 Claims, 2 Drawing Figures

FIG. 1
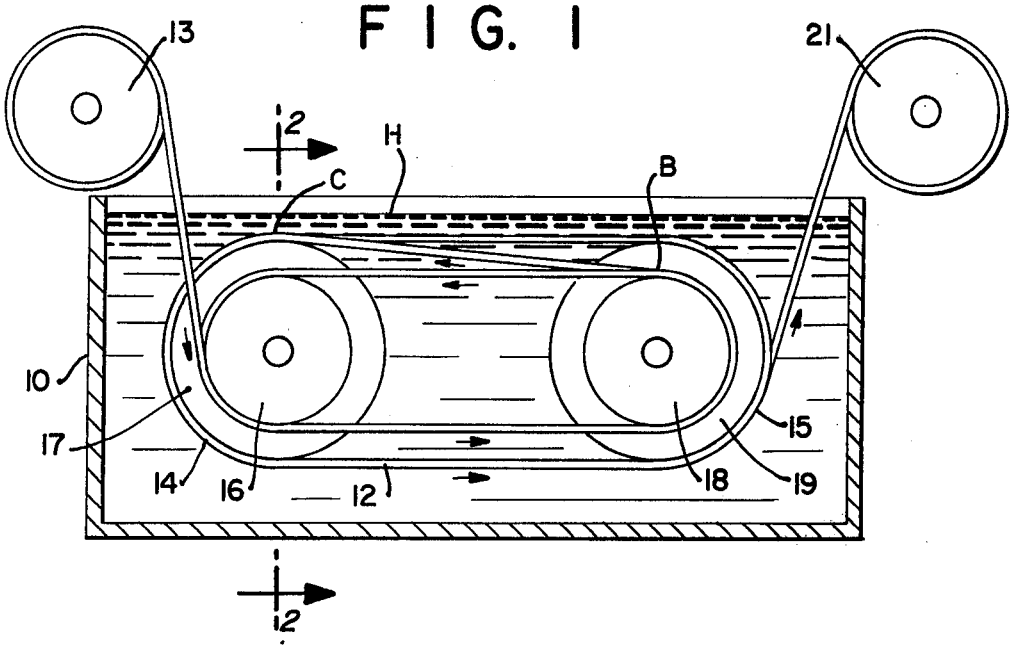
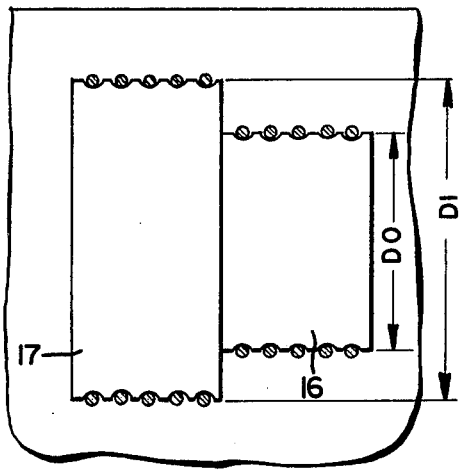
FIG. 2

METHOD FOR PROVIDING STRONG WIRE AND STRIP

FIELD OF THE INVENTION

This invention relates to a process for improving the strength of metal wire or strip.

DESCRIPTION OF THE PRIOR ART

The chemical compositions of the metal alloys to which this invention is directed are well known and include those alloys listed in the "Steel Products Manual: Stainless and Heat Resisting Steels" published by the American Iron and Steel Institute (AISI) now of Washington, D.C. in 1974 and designated as austenitic with the further proviso that these alloys at least initially have an Md temperature of no higher than about 100° C (i.e., plus 100° C) and an Ms temperature no higher than minus 100° C. It will be apparent that the AISI Series Designation 200 and 300 are of interest here. Other alloys contemplated here, again, must be austenitic and have the stated Md and Ms temperatures. These alloys include certain manganese-substituted non-stainless alloys containing iron, manganese, chromium, and carbon exemplified by those alloys designated by DIN (Deutsche Industrie Norme) specifications X40 Mn Cr 18 and X 40 Mn Cr 22 and described on pages 655 and 656 of the Metallic Materials Specification Handbook published by E & FN Spon Ltd., London 1972.

The term "austenitic" involves the crystalline microstructure of the alloy, which is referred to as austenitic or austenite in this specification when at least about 95 percent by volume of the microstructure has a face-centered cubic structure. Such alloys can be referred to as being essentially or substantially in the austenitic phase. It is understood that the metal alloys of concern here are essentially in the austenitic or austenite phase at the temperature at which the deformation step is carried out regardless of the work or temperature previously applied, e.g., the metal or alloy subjected to the deformation step may have been previously annealed yet it is essentially austenitic when the step is applied.

The other microstructure with which we are concerned here is a body-centered cubic structure and is referred to as martensitic or martensite. When at least about 95 percent by volume of the structure is martensitic, the alloy is considered here to be essentially or substantially in the martensite phase.

The microstructure can, of course, contain both an austenite phase and a martensite phase and the processing to be discussed here both in terms of the prior art and the present invention is one of transformation of at least part of the austenite to martensite thus changing the microstructure of the alloy treated.

The Md temperature is defined as the temperature above which no martensitic transformation will take place regardless of the amount of mechanical deformation which is applied to the metal or alloy and can be determined by a simple and conventional tensile test carried out at various temperatures.

The Ms temperature is defined as the temperature at which martensitic transformation begins to take place spontaneously, i.e., without the application of mechanical deformation. The Ms temperature can also be determined by conventional tests.

Some examples of Md temperatures are as follows:

| AISI stainless steel type no. | Md Temperature (° C) |
|---|---|
| 301 | 43 |
| 302 | 13 |
| 304 | 15 |
| 304L | 18 |

The 301, 302, 304 and 304L steels have Ms temperatures below minus 196° C.

As noted, the deformation referred to is a mechanical deformation, and takes place in the area of plastic deformation, which follows the area of elastic deformation. It is caused by subjecting the material to a stress beyond its elastic limit sufficient to change the shape of all or part of the workpiece.

The form or shape of the material to which the present invention is directed is wire or strip prepared and handled by conventional techniques except as otherwise described in this specification.

The physical properties relevant to the present invention include those of tensile strength, torsional yield strength, and formability.

The tensile strength property can readily be determined from a simple uniaxial tensile test as described in ASTM standard method E-8. This method appears in part 10 of the 1975 Annual Book of ASTM Standards published by the American Society for Testing Materials, Philadelphia, Pa. The tensile strength is the maximum tensile stress which the material is capable of sustaining. Tensile strength is the ratio of the maximum load during a tension test carried to fracture to the original cross sectional area of the specimen.

The torsional yield strength of wire, for example, can be determined by twisting a finite length of wire over increasing angles and observing when a first permanent angular distortion occurs. A two percent torsional yield strength is defined as the shear stress occurring at the surface of the wire when twisted over an angle sufficient to give rise to a two percent permanent angular offset. A similar definition holds for a five percent torsional yield strength.

A standard formability test for wire used in spring manufacture is to wrap the wire on an arbor having a diameter equal to the wire diameter. The wire passes the test if it withstands fracture during this test. It is clear that in such a wrapping test, the outer skin of the wire undergoes the largest amount of plastic deformation and, therefore, requires the largest ductility. A typical formability requirement for strip is that the strip withstand fracture in a ninety degree bend test around a radius equal to three times the strip thickness.

Practically all commercially available high strength wire is presently produced by wire drawing processes. Typically, the starting materials from which the wire is drawn are slender rods or bars of metal, commonly referred to as wire rods, which are hot-rolled from steel billets to the desired diameter of the starting rod. The cross-sectional area of the starting rod is reduced to the final desired wire size in a series of consecutive drawing steps, each step consisting of drawing the wire through a die having a progessively smaller cross-sectional opening. The cross-sectional area of the wire is reduced about twenty percent in each drawing step. Since a substantial amount of work-hardening is required to produce high-strength wire, a large number of drawing steps are necessary for strengthening the metal, rather than for purposes of size reduction. Consequently, the general practice is to select a starting annealed wire substantially oversized relative to the cross-sectional area of the finished wire to allow for reductions in area which are incidental to the desired work-hardening of the metal during drawing. For high-strength wire of the type used by spring manufacturers, the total reduction in cross-sectional area of the starting annealed material is generally from about seventy-five to ninety percent.

The undesirable effects of drawing on the mechanical properties of the resultant wire are well recognized in the art. The principal disadvantage inherent in drawing is the large frictional force generated between the die-wall and the work metal as the wire is forcibly drawn through the narrow opening of the die. This results in preferential work-hardening of the outer portion (or skin) of the wire relative to the inner core to the extent that the finished product is not uniformly strengthened. Therefore, wire which is drawn will have a highly strengthened skin and a core which is strengthened to a much lesser degree. Thus, the extent to which a wire can be strengthened by drawing is limited by the tensile strength at which the skin portion cracks or ruptures.

Moreover, the usable tensile strength of high-strength wire of the type used by spring manufacturers is further limited by a requirement of adequate formability. For instance, wire less than 0.25 inch in diameter is expected to withstand without fracture wrapping on an arbor with a diameter equal to the wire diameter. In such a wrapping test the outer fibers of the wire undergo the largest amount of plastic deformation and therefore require the largest ductility. The preferential work-hardening of the skin of the wire during drawing severely reduces the formability of the wire because the skin material becomes more brittle and less ductile as the cross-sectional area due to cold drawing decreases.

It is also well recognized in the art that these undesirable effects of drawing on the properties of the wire are dependent upon the wire diameter, thinner sections being capable of more cold drawing before skin cracking occurs than thick sections.

This is reflected in the fact, for example, that commercial high-strength 302 stainless steel wire, the most commonly used stainless wire for spring applications, can be obtained having an ultimate tensile strength (UTS) of 320,000 psi for 0.01 inch diameter wire, while at 0.25 inch diameter, the UTS is about 175,000 psi. Thus, the extent to which a wire can be strengthened by drawing is limited by the tensile strength at which the skin portion cracks or ruptures. It is clear, therefore, that conventional drawing operations are highly inefficient methods of strengthening relatively large diameter wire.

Similar problems arise in the manufacture of high strength steel strip. Such strip is commonly produced by rolling. It is clear that the material strengthening effects that are produced by rolling are propagated into the material from the boundary surface between said material and the rolls in such a manner that most of the strength increase due to cold rolling is concentrated in the skin portion of the strip and appears to a lesser extent throughout the interior regions of the strip. Consequently, the undesirable effects of drawing on the mechanical properties of wire will also appear during the rolling of strip. In particular, the extent to which strip can be strengthened by rolling and will still have sufficient formability for the manufacture of, e.g., springs, is limited by the tensile strength at which the skin portion of the strip cracks or ruptures during the forming of said springs. Preferential work-hardening of the surface of the strip during rolling therefore limits the usable tensile strength of the rolled strip and for a given formability as specified, e.g., in a bend test, the usable tensile strength will decrease with increasing strip thickness.

It has been found that drawing wire or rolling strip from the alloys referred to above at cryogenic temperatures, thereby partially converting the austenitic material to the martensite phase, enhances the tensile strength of the wire or strip without the necessity of taking large reductions in diameter or thickness. Although conceptually attractive, insofar as work-hardening of the alloys are concerned, drawing at cryogenic temperatures has serious practical limitations which have prevented such a process from gaining commercial acceptance. One limitation is the absence of lubricants capable of effectively reducing friction between the wire and the die-wall at cryogenic temperatures and thereby producing wire with the smooth and defect-free surface finish required for critical spring applications. Surface irregularities, such as notches and cracks originating from inadequate lubrication tend to decrease the fatigue life of springs, for example.

Moreover, the problem inherent with all wire drawing and strip rolling operations, namely, the preferential work-hardening of the outer portion of the wire or strip relative to the core, is even more pronounced at cryogenic temperatures. Consequently, the overwhelming majority of commercially produced high-strength wire and strip is drawn and rolled, respectively, at room temperatures.

Further, it is desirable that the torsional yield strength of a wire used for spring applications be as high as possible in relation to the tensile strength of the wire. It is found, however, that for conventionally drawn AISI 302 stainless steel wire the ratio of the two percent torsional yield strength to the tensile strength lies in the range of 0.3 to 0.4, which is considered low from a commercial point of view. A similar problem is found in bending strip and is referred to as high proportional limit in bending.

In order to take advantage of the great increase in tensile strength, which can be achieved at cryogenic temperatures, it is apparent that three problems have to be solved: (1) lubrication at cryogenic temperatures; (2) the obtainment of high tensile strengths independent from wire diameter or strip thickness so that relatively large diameter wire or thick strip can be processed at these cryogenic temperatures particularly with respect to wire having a diameter, and strip having a thickness, above about 0.02 inch; and (3) improvement of the torsional yield strength over those strengths presently available in wire where, for example, the application is in helical tension or compression springs for here the stresses are of a torsional nature, the highest stresses being shear stresses at the surface of the workpiece, or improvement in the high proportional limit in bending strip.

SUMMARY OF THE INVENTION

An object of this invention, therefore, is to provide an improvement in known cryodeformation processes for preparing wire or strip whereby the lubrication problem is eliminated; tensile strengths are liberated from their dependence on wire diameter and strip thickness; and torsional yields or bending limits are improved over those previously attainable.

Other objects and advantages will become apparent hereinafter.

According to the present invention, a process has been discovered, which maintains the advantages achieved in tensile strength at cryodeformation temperatures while eliminating the need for lubricants; freeing the tensile strength property from its dependence on wire diameter and strip thickness; and improving torsional yields and bending limits. The process is carried out with respect to wire or strip having a composition consisting essentially of an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C and an Ms temperature of no higher than about minus 100° C comprising the following step:

stretching the wire or strip uniaxially at a strain of at least about 10 percent and at a temperature no higher than about minus 75° C in such a manner that the wire or strip has a martensite phase of at least about 50 percent by volume and an austenite phase of at least about 10 percent by volume.

Final optimization of the strength property is achieved by subjecting the metal alloy to conventional ageing at a temperature in the range of about 350° C to about 450° C.

BRIEF DESCRIPTION OF THE DRAWING

FIGS. 1 and 2 are schematic diagrams illustrating the side view of apparatus, and cross-section in part, which can be used to carry out the stretching step referred to above.

DESCRIPTION OF THE PREFERRED EMBODIMENT

The alloys to which the process is applied are described above and, as noted, are conventional. The only prerequisites are that when the deformation step is applied they meet the definition of austenitic, and their Md temperatures are no higher than about 100° C and their Ms temperatures are no higher than about minus 100° C.

The stretching is a mechanical deformation and takes place in that region known as the region of plastic deformation, and the stretching techniques which can be used are conventional as well as the apparatus availed of to carry out these techniques. It will be readily apparent to those skilled in the metallurgical arts what apparatus can be used for the uniaxial stretching required here.

The deformation must, of course, be sufficient to provide the stated percentages of martensite and austenite, which are first determined by conventional analytical techniques such as X-ray diffraction or magnetic measurements and then on the basis of the experience of the operator with the various alloys on deformation in the noted temperature ranges. To more accurately define deformation, it has been set forth in terms of strain. It is found that for the materials to which the invention applies, the strengthening effects can be evaluated from the observed strengthening effects during a simple tension test using the principle of "equivalent uniaxial" strain or "effective" strain as set forth, e.g., in "Mechanical Metallurgy" by G. E. Dieter, Jr., published by McGraw-Hill Book Company (1961), on page 66.

The minimum strain in the deformation is at least about 10 percent. There is no upper limit for percent strain except that of practicality in that at a certain point the change in microstructure and strength-toughness properties become minimal and, of course, there is a limit as to fracture of the material. In any case the suggested strain range is from about 10 to about 60 percent and, preferably, about 20 to about 40 percent.

As pointed out, the initial alloy utilized in the process is at least about 95 percent by volume austenite, the balance being martensite, and there is, preferably, 0 to about 2 percent by volume martensite and about 98 to about 100 percent by volume austenite in the alloy. The alloys under consideration here are considered stable, i.e., austenitically stable, at ordinary temperatures.

The temperature at which the stretching is conducted is less than about minus 75° C and is, preferably, less than about minus 100° C. These temperatures can be achieved by carrying out the step in liquid nitrogen (B.P. minus 196° C); liquid oxygen (B.P. minus 183° C); liquid argon (B.P. minus 186° C); liquid neon (B.P. minus 246° C); liquid hydrogen (B.P. minus 252° C); or liquid helium (B.P. minus 269° C). Liquid nitrogen is preferred. A mixture of dry ice and methanol, ethanol, or acetone has a boiling point of about minus 79° C and can also be used. The lower the temperature, the less the strain needed for each percent of improvement in tensile strength. It should be noted here that the deformation introduces energy into the material and this causes a rise in temperature, which may end up in a range above about minus 75° C. This will not effect the process provided the conditions of the deformation are carried out prior to the temperature rise. Further, cooling to the defined low temperatures can take place prior to or at the same time as deformation, the closer the coordination between the two, the faster and, consequently, more economical the process.

Under the deformation, i.e., stretching, step, the microstructure of the alloy is changed appreciably so that at least 50 percent by volume is in the martensite phase and at least 10 percent by volume is in the austenite phase. The preferred range lies in the area of about 60 to about 90 percent by volume martensite and about 10 to about 40 percent by volume austenite.

At all times in this specification the microstructure of the initial alloy and of the products of the cryodeformation and ageing is considered to consist essentially of austenite and/or martensite in the percentages previously stated. Any other phases present are not of interest here since such phases, if they are present at all, are less than about one percent by volume and have little or no effect on the properties of the alloy.

After the stretching step, the alloy is preferably subjected to ageing to optimize strength. Ageing is carried out in a conventional manner at a temperature in the range of about 350° C to about 450° C and, preferably, in the range of about 375° C to about 425° C. Ageing time can range from about 30 minutes to about 10 hours and is preferably in the range of about 30 minutes to about 2.5 hours. Conventional testing is used here to determine the temperature and time, which give the highest tensile strength and yield strength.

It will be noted, that ageing tends to improve yield strength even more than tensile strength, and for the alloy to reach the highest strength levels can be carried to a point where yield strength approximates the tensile strength.

Stretching is defined as a deformation of workpieces in which one dimension, called the longitudinal direction, is much larger than the two other dimensions as in wire or strip. The deformation comprises applying forces in the longitudinal direction so that essentially the entire cross-section of the workpiece is under uniform uniaxial tensile stress during the deformation. The tensile stresses are of sufficient magnitude to induce permanent plastic deformation in the workpiece, the application of stress being described in terms of percent strain. Since the term "stretching" as used herein is in contradistinction to other deformation processes such as drawing and rolling which involve multiaxial states of stress, the term "stretching...uniaxially" has been used to further accentuate the difference for as those skilled in the art will recognize the longitudinal elongation of a wire during drawing through a die occurs under the influence of compressive stresses in directions transverse to the drafting direction in addition to the tensile stresses in the drafting or longitudinal direction.

Two forms of material are of particular interest in the instant stretching process because of their peculiar dimensions, i.e., the longitudinal direction being much larger than the other two dimensions. These forms are wire and strip which have this common dimensional characteristic. It has been pointed out that the deformation step prescribed here is a non-drawing and a non-rolling step to emphasize the importance of uniaxial stretching and exclude the techniques whereby the workpiece is not uniformly strengthened, i.e., where the skin portion is highly strengthened while the core portion is strengthened to a much lesser degree, thus limiting the tensile strength of the drawn wire or rolled strip to that at which the skin portion cracks or ruptures. As noted heretofore, this deficiency in drawn wire leads to further problems in a specific application, i.e., that of coil springs, where formability is of special interest. In this case, the skin portion has to be sufficiently ductile to withstand wrapping about an arbor without fracture, but, unfortunately, the preferential work-hardening of the skin during drawing causes the skin to become more brittle and less ductile thus reducing formability The low temperature stretching process described here is shown to improve tensile strength and formability as well as torsional and fatigue properties.

The stretching step must be conducted in the prescribed temperature range, i.e., at a temperature less than minus 75° C, and the defined strain must be achieved by stretching to obtain all of the benefits of this invention. Otherwise, conventional techniques and apparatus, as noted, can be used to accomplish the step.

One form of apparatus, which is useful in carrying out the second step stretching where wire is the workpiece, and the procedure used in connection therewith can be described as follows with reference to FIGS. 1 and 2: the process is carried out in an insulated tank 10 filled to a certain level H with a cryogenic fluid, such as liquid nitrogen, the quantity of fluid being such that it completely covers the stretching operation. The prestrained wire 12 is fed from a supply spool 13 into tank 10 and is passed around a pair of capstans 14 and 15, which are rotatably dispersed in tank 10 beneath the surface of the fluid. The two capstans are identical, and they each are comprised of two cylindrical rolls of different diameters. A cross section of capstan 14 taken along line 2-2 of FIG. 1 appears in FIG. 2 and shows grooves with wire being guided in the grooves to prevent "walking". The outer groove of roll 16 is the groove farthest removed from roll 17; the inner groove of roll 16 is the groove adjacent to roll 17; the inner groove of roll 17 is the groove adjacent to roll 16; and the outer groove of roll 17 is the groove farthest removed from roll 16. The diameter of the narrow roll is designated D0 and the diameter of the wide roll is designated D1. After entering the cryogenic fluid, wire 12 is carried in the direction of the arrows along the outer groove of roll 16 of capstan 14 around roll 16 and then passes to the outer groove of roll 18 of capstan 15 and continues to go back and forth between rolls 16 and 18 through the grooves provided therefor to the inner grooves while gradually cooling down to the temperature of the cryogenic fluid. The tractive force on wire 12 also builds up gradually through friction until the wire reaches a point B on the inner groove of roll 18 where it passes to point C on the inner groove of roll 17 of capstan 14. Since both capstans rotate at the same angular velocity, a uniform stretching takes place. The amount of stretch is equal to D1 - D0/D0. After point C, the wire continues from roll 17 to roll 19 from the inner groove to the outer groove in a similar fashion to its progress along rolls 16 and 18, gradually moving to the outer grooves while the tractive forces decrease. After passing through the outer groove of roll 19, wire 12 leaves tank 10 and is wound on takeup reel 21.

The following examples illustrate the invention:

EXAMPLES 1 to 3

Annealed AISI type 302 stainless steel wire is used, the chemical composition being as follows:

| Element | | Percent by weight |
|---|---|---|
| C | | 0.07 |
| S | | 0.021 |
| P | | 0.02 |
| Mn | | 0.52 |
| Si | | 0.37 |
| Ni | | 8.5 |
| Cr | | 18.9 |
| Mo | | 0.22 |
| Cu | | 0.19 |
| V | | 0.05 |
| Zr | less than | 0.02 |
| Ti | less than | 0.01 |
| Al | less than | 0.05 |
| Fe | | balance |
| Total | | 100 |

Annealing is accomplished with conventional techniques by heating the material between 980° C and 1150° C followed by rapid cooling.

In example 1, which illustrates the invention, the annealed wire is stretched at a 20 percent strain under liquid nitrogen at minus 196° C according to the procedure and with the apparatus described above in the specification and in FIGS. 1 and 2. The wire is then aged conventionally for 1.5 hours at 400° C. Martensite content of the final processed wire of example 1 is at least 60 percent by volume.

The processing at minus 196° C is done in an insulated metal dewar filled with liquid nitrogen so that the entire specimen is immersed in a liquid nitrogen bath. Ageing treatment is carried out on a Lindberg Model 59744 furnace in air. The surface oxidation of the wire occurring during ageing is assumed not to affect the resulting mechanical properties. The temperature along the length of the wire does not vary more than ± 10° C from the preset temperature.

Percent by volume martensite is given as determined by quantitative X-ray diffraction technique. The balance (to make up a total of 100 percent) is considered to be austenite. Other phases or impurities are not more than one percent by volume and are not considered here. Note: All specimens in all examples contain at least 95 percent by volume austenite prior to deformation.

The example 1 wire shows adequate formability in that it can be wrapped around an arbor equal to the final wire diameter without fracture.

Tensile tests for all examples are performed according to ASTM method E8 and torsional tests as described above in the specification.

Examples 2 and 3 are comparative examples wherein the annealed wire is processed according to prior art techniques. In both examples, the wire is conventionally drawn to full hardness which represents a strain of at least 75 percent at 21° C. The wire is then subjected to conventional ageing for 1.5 hours at 400° C just as in Example 1. Surface oxidation during ageing is assumed not to affect resulting mechanical properties and temperature does not vary more than ± 10° C, also as in Example 1.

Final wire diameter, tensile strength after ageing, torsional yield strength after ageing, and the ratio of torsional yield strength to tensile strength are given in the Table.

TABLE

| Example | Final wire diameter in inches | Tensile strength ksi (Mpa) | Torsional yield strength 2% ksi (Mpa) | Torsional yield strength 5% ksi (Mpa) | Ratio: 2% torsional yield strength to tensile strength |
|---|---|---|---|---|---|
| 1 | 0.027 | 256(1,764) | 132(909) | 154(1,061) | 0.52 |
| 2 | 0.027 | 312(2,150) | 105(723) | 142(978) | 0.34 |
| 3 | 0.118 | 269(1,853) | 108(744) | 144(992) | 0.40 |

Note:
ksi = 1000 psi
Mpa = Megapascal

We claim:

1. A process for improving the strength characteristics of wire or strip having a composition consisting essentially of an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C and an Ms temperature of no higher than about minus 100° C comprising the following step:

a. stretching the wire or strip uniaxially at a strain of at least about 10 percent and at a temperature no higher than about minus 75° C in such a manner that the wire or strip has a martensite phase of at least about 50 percent by volume and an austenite phase of at least about 10 percent by volume.

2. The process defined in claim 1 comprising the following additional step:

b. ageing the material produced in step (a) at a temperature in the range of about 350° C to about 450° C.

3. The process defined in claim 2 wherein, in step (a), the strain is about 10 to about 60 percent and the temperature is less than about minus 100° C, and the product of said step (a) has a martensite phase of at least about 60 percent by volume and an austenite phase of at least about 10 percent by volume.

4. The process defined in claim 3 wherein step b. is carried out at a temperature in the range of about 375° C to about 425° C.

5. The process defined in claim 1 wherein the material is a stainless steel alloy of the AISI 300 series.

6. The process defined in claim 2 wherein the material is a stainless steel alloy of the AISI 300 series.

7. The process defined in claim 3 wherein the material is a stainless steel alloy of the AISI 300 series.

8. The process defined in claim 4 wherein the material is a stainless steel alloy of the AISI 300 series.

* * * * *